US006491158B2

(12) United States Patent
Chen

(10) Patent No.: US 6,491,158 B2
(45) Date of Patent: Dec. 10, 2002

(54) GLASSES BOX WITH FUNCTION OF PRESSABLE PEN

(76) Inventor: Chih Chen, No. 9, Alley 11, Lane 327, Chung Shan Rd., Sec. 2, Chung Ho City, Taipei Hsien (TW)

( * ) Notice: Subject to any disclaimer, the term of this patent is extended or adjusted under 35 U.S.C. 154(b) by 23 days.

(21) Appl. No.: 09/841,109

(22) Filed: Apr. 25, 2001

(65) Prior Publication Data

US 2002/0157968 A1 Oct. 31, 2002

(51) Int. Cl.[7] ..... A45C 11/04
(52) U.S. Cl. ..... 206/5; 206/223; 401/195
(58) Field of Search ..... 206/5, 216, 223, 206/576, 320, 224, 38, 234; 401/195

(56) References Cited

U.S. PATENT DOCUMENTS 3,734,283 A * 5/1973 Simmons ..... 206/445
4,166,555 A * 9/1979 Cheetham ..... 206/537
4,174,048 A * 11/1979 Volpe, Jr. ..... 206/537
4,812,069 A * 3/1989 White et al. ..... 206/233
5,007,756 A * 4/1991 Wey ..... 128/844
5,568,741 A * 10/1996 Parsons ..... 206/37.1
5,929,967 A * 7/1999 Conner ..... 206/5
5,950,827 A * 9/1999 Odom et al. ..... 206/364
6,145,986 A * 11/2000 Conner ..... 206/5
6,270,274 B1 * 8/2001 Chao ..... 401/195

* cited by examiner

*Primary Examiner*—Shian Luong
(74) *Attorney, Agent, or Firm*—Troxell Law Office PLLC

(57) ABSTRACT

A glasses box with function of pressable pen is disclosed. A cover is pivotally installed on a cylinder for being turned at any time. A longitudinal slot and a rectangular though hole are installed at one lateral wall of the cylinder. Thereby, an elastic pressable piece 3 is engaged to the upper end of the filler. The filler is vertically passed through the cylinder so that two sides of the pressable piece are engaged into the trench. A stop and a stopper at the surface of the pressable piece is capable of being engaged to the rectangular though hole. The filler is telescopic at the lower end of the cylinder so that the glasses box with function of pressable pen is achieved.

3 Claims, 5 Drawing Sheets

GLASSES BOX WITH FUNCTION OF PRESSABLE PEN

FIELD OF THE INVENTION

The present invention relates to a glasses box with function of pressable pen, and especially for a glass box for receiving glasses and having a function of writing. The box has a long tube shape and has a structure of a pressable piece so as to have functions of storing a paif of glasses and writing.

BACKGROUND OF THE INVENTION

The prior presbyopic glasses is often used as in reading or writing. In general, it is made as a very compact structure, even the glasses frame is designed with a width of only 14 mm (referring to FIG. 1) so that it can be used conveniently. Since the presbyopic glasses has a very compact size and thus the glasses box has a smaller size than the prior art ones. However, in general, the presbyopic glasses are used in reading, and thus it is often that the reader is also necessary to write. If now the user needs to search for a pen for writing, it becomes very inconveniently. Therefore, there is an eager demand for a novel design which has function of glasses box and pen.

SUMMARY OF THE INVENTION

Accordingly, the primary object of the present invention is to provide a glasses box with function of pressable pen. A compact glass box is made like a pen tube. The tube is formed with slots and other required structure. The filler of the pen is telescopic at the lower end of the cylinder so that the glasses box with function of pressable pen is achieved, which can be carried easily.

The various objects and advantages of the present invention will be more readily understood from the following detailed description when read in conjunction with the appended drawing.

DETAILED DESCRIPTION OF THE PREFERRED EMBODIMENTS

Figure 1:
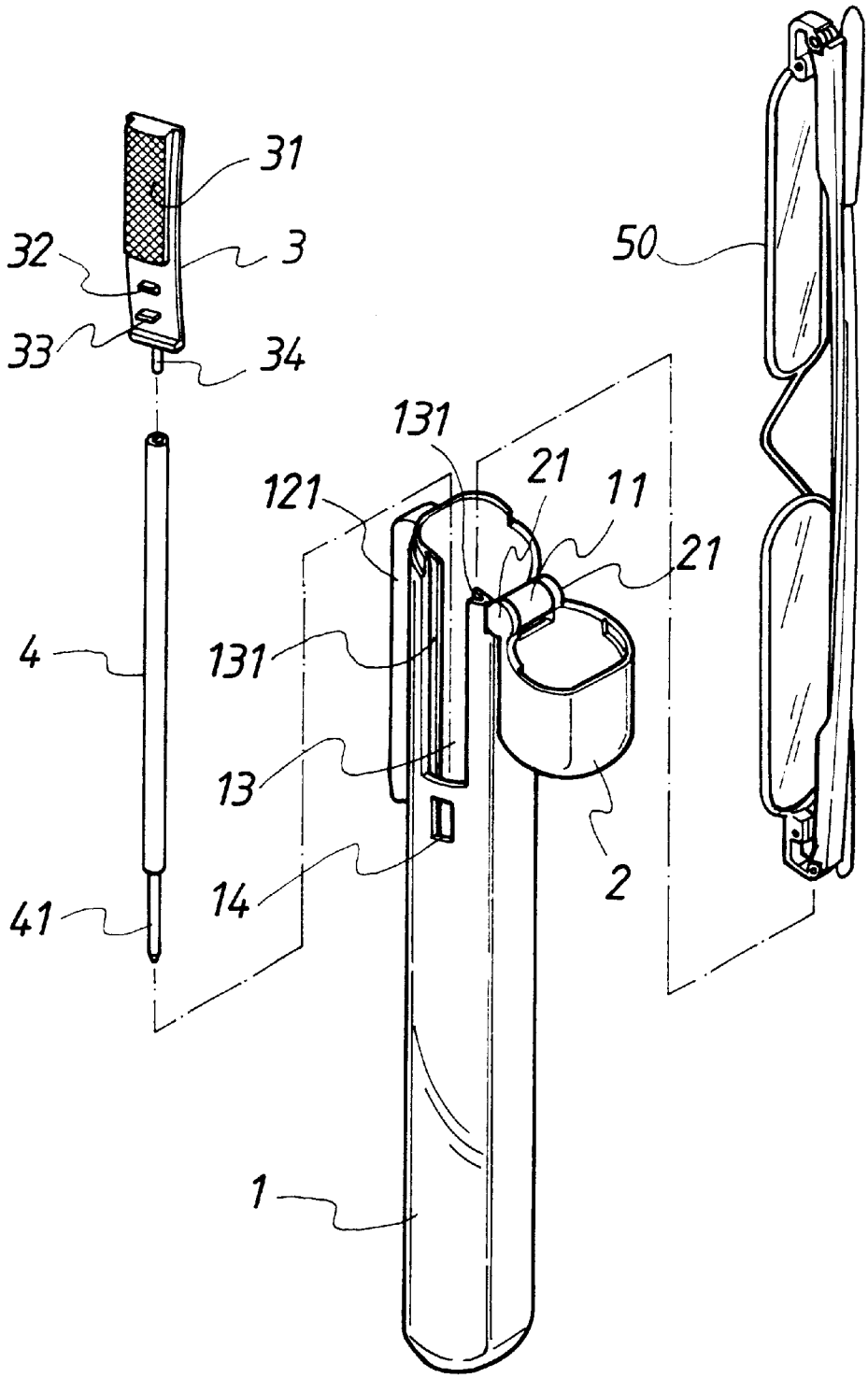
FIG. 1 is an exploded perspective view of the present invention.
Figure 2:
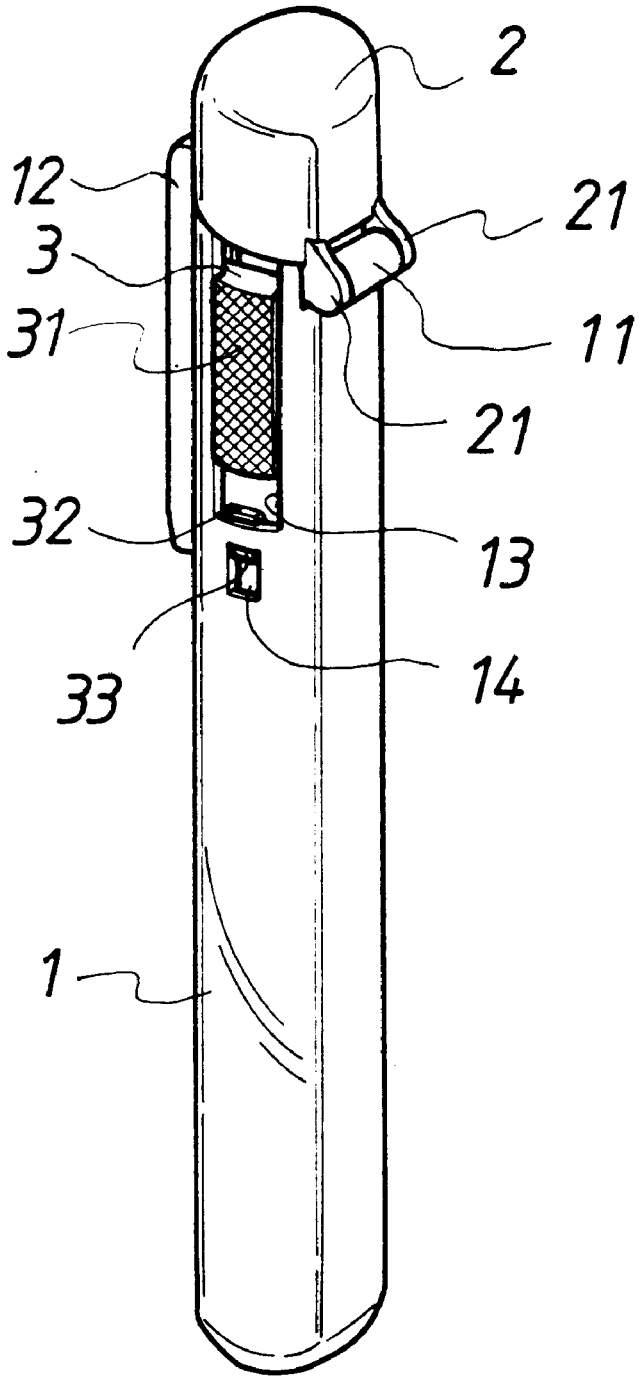
FIG. 2 is an assembled perspective view of the present invention.

Referring to FIGS. 1 and 2, the glasses box with function of pressable pen of the present invention is illustrated. The glasses box of the present invention includes a cylinder 1, a cover 2, a pressable piece 3 and a filler 4 so as to be formed with a glasses box for storing a pair of glasses 50 and having a function of a pen.

The cylinder 1 is a long hollow tubular long cylinder. The front edge of the upper opening thereof is installed with a pivotal convex seat 11. The rear side of the outer wall of the cylinder extended downwards is formed with clamping piece 12. At any selected side is installed with an axial rectangular slot 13. A rectangular though hole 14 is formed at the lower wall of the slot 13. An axial trench 131 is formed for receiving the pressable piece 3. The bottom of the cylinder 1 with respect to the position of the slot 13 is installed with a through hole 15.

The cover 2 is a short hollow cylinder having a configuration correspondent to the cylinder 1. A front side of the lower opening thereof is installed with two pivotal convex seats 21 for being pivotally installed to above cylinder 1.

The pressable piece 3 is made of plastics integrally and is an elastic cambered rectangular piece. Thereby, a stop 31 is installed at the upper portion of the front side of the cambered portion. A buckle 32 and a stopper 33 are installed at the lowre side of the stop 31. The lower end of the pressable piece 3 is installed with a post 34 for securing the filler.

The filler 4 is a prior art object general used in a ball pen or a neutral pen and thus the detail structure will not be further described herein.

Figure 3:
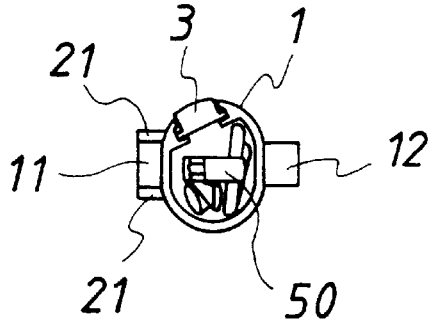
FIG. 3 is an assembled cross sectional view of the present invention.
Figure 4:
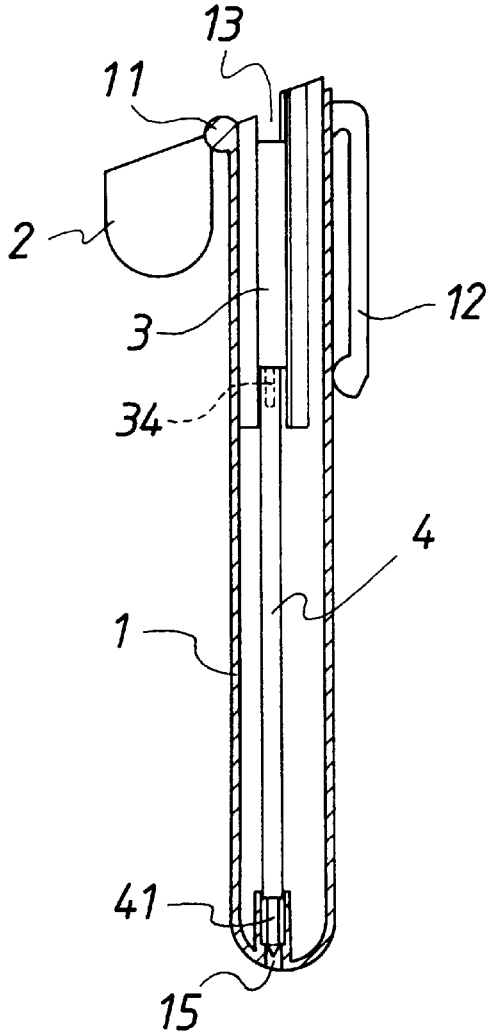
FIG. 4 is an elevation cross sectional view of the present invention.

By the structure illustrated in FIGS. 1, 3 and 4, the two pivotal convex seats 21 of the cover 2 is pivotally engaged with the pivotal convex seat 11 of the cylinder 1 so that the cover 2 can be turned forwards and thus a compact glasses pair 50 can be received therein. The lower post 34 of the pressable piece 3 is inserted into the tube end of the filler 4, and thus the pen head 41 of the filler 4 is inserted into the cylinder 1 and then is inserted into the lower though hole 15. The two sides of the pressable piece 3 can be engaged into the trench 131 so that the stop 31 protrudes out of the slot 13, and thus it can be pushed upwards and downwards by fingers. The stop 31 and stopper 32 of the pressable piece 3 pass out from the rectangular though hole 14 of the cylinder 1, and thus the lower filler 4 has a telescopic structure. Therefore, a glasses box with function of pressable pen of the present invention is formed.

Figure 5:
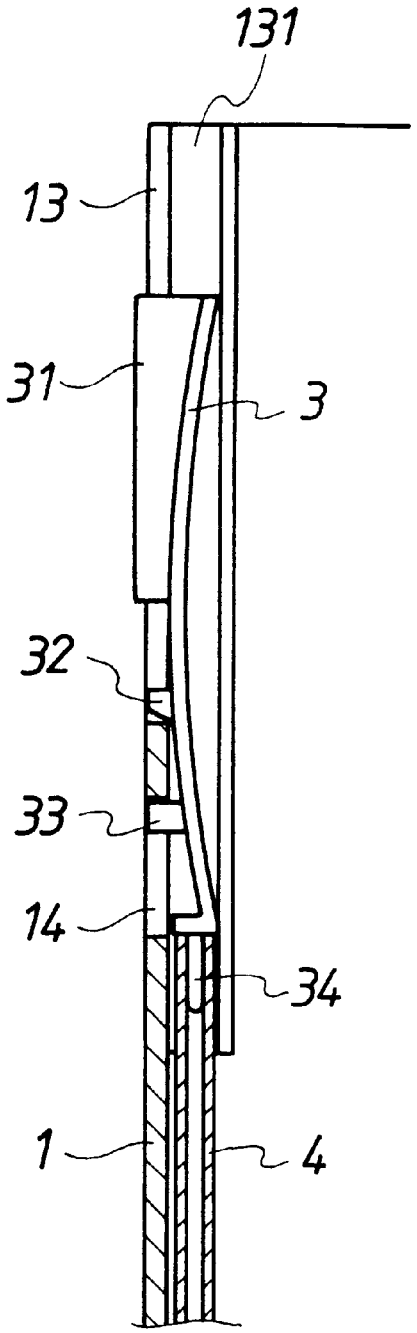
FIG. 5 is a schematic view of the pressable piece of the present invention.
Figure 6:
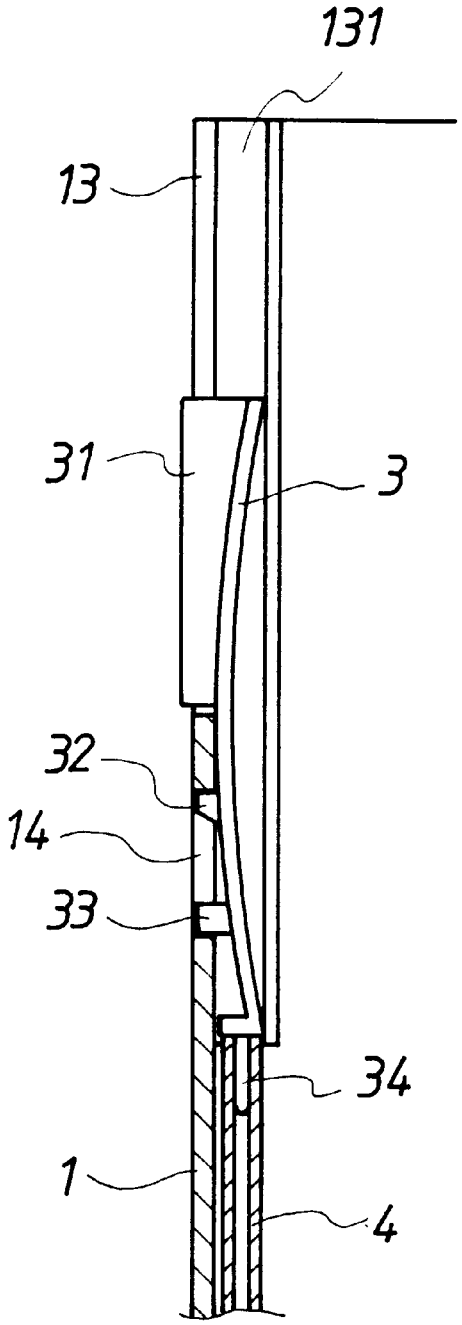
FIG. 6 is a schematic view showing the operation of the pressable piece in the present invention.
Figure 7:
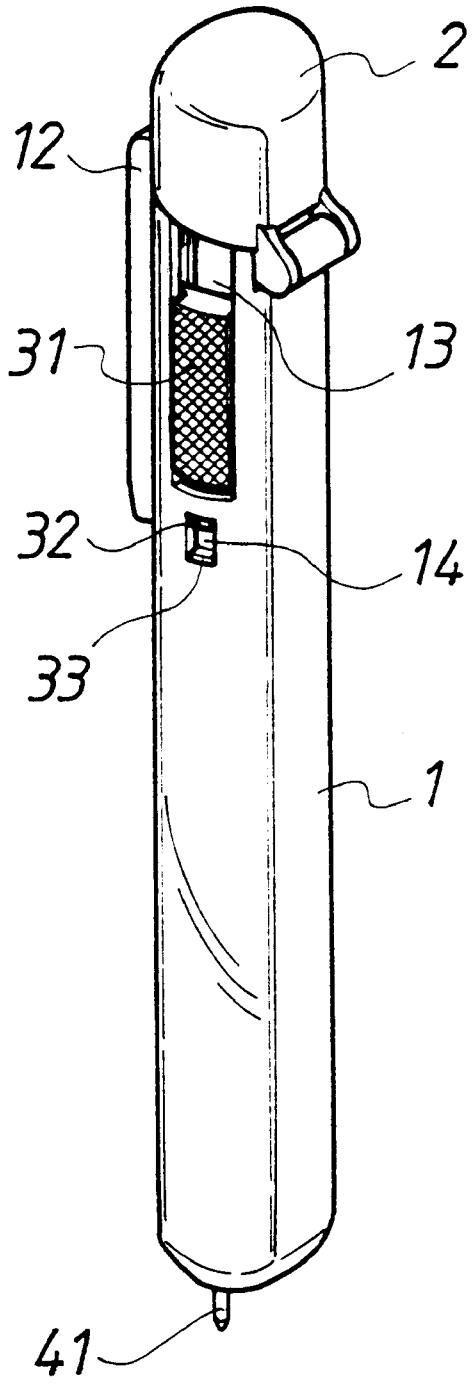
FIG. 7 is a schematic view showing the writing of filler in the present invention.

By the design of the present invention, when an old people is desired to read newspapers through a pair of presbyopic glasses. The user may open the cover 2 and then extracts the glasses 50. Meanwhile, the pen can be used to write and sign. Furthermore, by the glasses of the present invention, the pressable piece 3 can be pressed and then pushed downwards so that the buckle 32 moves toward upper wall of the rectangular though hole 14 from the slot 13 of the cylinder 1 so as to be buckled therein (referring to FIGS. 5 and 6). Moreover, at the time for pressing the pressable piece 3, the filler 4 may pass out of the lower end of the cylinder 1 (referring to FIG. 7), the use may hold the cylinder 3 for writing. On the contrary, when the user is desired to store the filler 4, the stop 31 of the pressable piece 3 is pressed by fingers so as to be reduced elastically, meanwhile, the pressable piece 3 is pushed to move upwards. Thus, the storage of the filler 4 can be controlled effectively. It is appreciated that by the glasses box with function of pressable pen of the present invention, an old people can use a pair of presbyopic glasses and meanwhile he (or she) may hold the pen by a hand. Thus, it is not necessary to look for a pen anywhere. Moreover, the user may insert the present invention into a pocket by the clamping piece 12 at the rear side of the cylinder 1 so that the glasses 50 and pen can be carried at the same time. Therefore, it is unnecessary to carry too many objects at the same time.

The present invention are thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A glasses box with function of pressable pen comprising a cylinder, a cover, a pressable piece and a filler so as to be formed with a glasses box for storing a pair of glasses therein and having a function of a pen; wherein the cylinder is a long tubular cylinder with a single opening; at a selected side of the cylinder is installed with an axial slot; a first though hole is formed at a lower wall of the slot; an axial trench is formed for receiving the pressable piece; and a bottom of the cylinder with respect to a position of the slot is installed with a second through hole;

a cover is a short hollow cylinder with a single opening and having a configuration correspondent to the cylinder;

the pressable piece is an integrally formed elastic rectangular piece having a cambered surface; a stop is installed at an upper portion of a front side of the cambered portion; a buckle and a stopper are installed at a lower side of the stop; a lower end of the pressable piece is installed with a post for securing the filler; and a filler is one in a ball pen or a neutral pen;

wherein by covering the cover on an opening of the cylinder, the cover is capable of opening and closing, and the post of the pressable piece is inserted into the tube end of the filler, and thus the pen head of the filler is further inserted into the cylinder and then is inserted into the lower though hole; two sides of the pressable piece are engaged into the trench so that the stop protrudes out of the slot, and thus it can be pushed upwards and downwards; the stop and stopper of the pressable piece pass out from the though hole of the cylinder, and thus the lower filler has a telescopic structure; therefore, a glasses box with function of pressable pen of the present invention is formed.

2. The glasses box with function of pressable pen as claimed in claim 1, wherein a pivotal convex seat is formed at the opening of the cylinder, a front side of the opening thereof is installed with two pivotal convex seats for being pivotally installed to the cylinder; the two pivotal convex seats of the cover is pivotally engaged with the pivotal convex seat of the cylinder so that the cover is capable of being turned forwards.

3. The glasses box with function of pressable pen as claimed in claim 1, wherein a rear side of a outer wall of the cylinder extended downwards is formed with clamping piece.

* * * * *